US010049550B2

(12) United States Patent
Nguyen

(10) Patent No.: US 10,049,550 B2
(45) Date of Patent: Aug. 14, 2018

(54) SMART WATCH WITH AUTOMATIC VOICE RECORDING AND ALARM

(71) Applicant: Sony Corporation, Tokyo (JP)

(72) Inventor: Djung N. Nguyen, San Diego, CA (US)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/727,029

(22) Filed: Oct. 6, 2017

(65) Prior Publication Data

US 2018/0033278 A1 Feb. 1, 2018

Related U.S. Application Data

(62) Division of application No. 13/401,193, filed on Feb. 21, 2012, now Pat. No. 9,805,576.

(51) Int. Cl.
*G08B 23/00* (2006.01)
*G08B 21/04* (2006.01)

(52) U.S. Cl.
CPC ..... *G08B 21/0446* (2013.01); *G08B 21/043* (2013.01); *G08B 21/0453* (2013.01)

(58) Field of Classification Search
CPC . G08B 21/0446; G08B 21/0453; G08B 21/02
See application file for complete search history.

(56) References Cited

U.S. PATENT DOCUMENTS 6,377,179 B1 4/2002 Fulton
7,400,245 B1 7/2008 Johnson
8,116,724 B2 * 2/2012 Peabody ..... G08B 25/016 455/404.2
8,441,356 B1 * 5/2013 Tedesco ..... G08B 21/0453 340/539.15
8,818,614 B1 8/2014 Lekutai
2003/0130771 A1 7/2003 Crank
2003/0231115 A1 12/2003 Stanners et al.
2004/0155781 A1 8/2004 DeOme
2005/0083195 A1 4/2005 Pham et al.
2006/0171453 A1 8/2006 Rohlfing et al.
2007/0200716 A1 * 8/2007 Haase ..... G08B 15/004 340/574

(Continued)

FOREIGN PATENT DOCUMENTS

CN 201058025 5/2008
CN 101268677 A 9/2008

(Continued)

*Primary Examiner* — Phung Nguyen
(74) *Attorney, Agent, or Firm* — John L. Rogitz

(57) ABSTRACT

A wearable accoutrement such as a wristwatch records noises within a wearer's vicinity, and white noises may be filtered out to output pure human voices. The voice recording feature can be activated manually or automatically during a "panic mode" as indicated by a loud noise or sudden biological changes such as an increase in heart rate or body temperature. The accoutrement can also monitor other environmental elements such as light, motion and audio and may be paired with a wireless phone such that noise from a stressful event can be sent to a remote server which processes the data. A motion sensor in the accoutrement may also activate an audible alarm in the event of physical trauma to the wearer to induce an attacker to flee.

8 Claims, 3 Drawing Sheets

(56) References Cited

U.S. PATENT DOCUMENTS

| | | | | |
|---|---|---|---|---|
| 2007/0273504 | A1 | 11/2007 | Tran | |
| 2007/0279852 | A1 | 12/2007 | Daniel et al. | |
| 2007/0286375 | A1* | 12/2007 | Baum | H04M 1/2474 379/201.01 |
| 2009/0164219 | A1 | 6/2009 | Yeung et al. | |
| 2009/0227888 | A1 | 9/2009 | Salmi et al. | |
| 2010/0030399 | A1 | 2/2010 | Zellner et al. | |
| 2010/0216429 | A1 | 8/2010 | Mahajan | |
| 2010/0217099 | A1 | 8/2010 | LeBoeuf et al. | |
| 2010/0267361 | A1 | 10/2010 | Sullivan | |
| 2010/0331145 | A1 | 12/2010 | Lakovic et al. | |
| 2011/0141276 | A1* | 6/2011 | Borghei | H04W 12/08 348/143 |
| 2011/0172503 | A1 | 7/2011 | Knepper et al. | |
| 2012/0194549 | A1 | 8/2012 | Osterhout et al. | |

FOREIGN PATENT DOCUMENTS

| | | | |
|---|---|---|---|
| CN | 101427916 | A | 5/2009 |
| CN | 101620766 | A | 1/2010 |
| CN | 102122319 | A | 7/2011 |
| CN | 202111804 | U | 1/2012 |
| WO | 2005077077 | A3 | 5/2006 |
| WO | 2007001467 | A1 | 1/2007 |
| WO | 2008113846 | A1 | 9/2008 |
| WO | 2008145134 | A1 | 12/2008 |

* cited by examiner

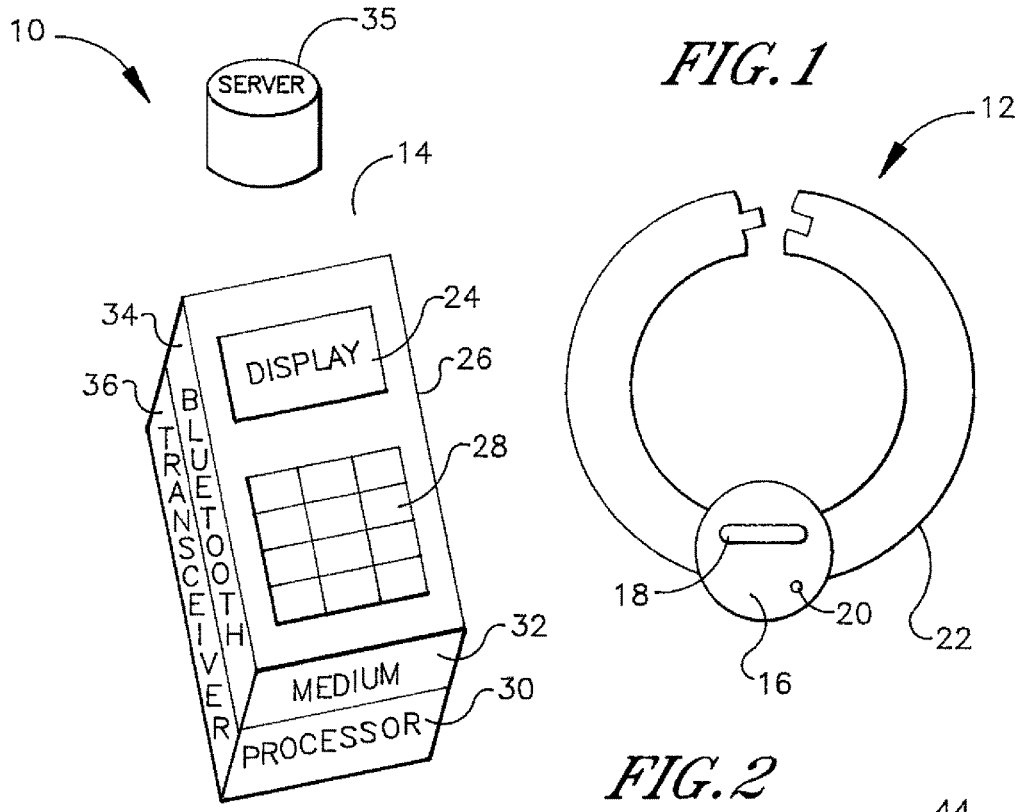
FIG. 1
FIG. 2
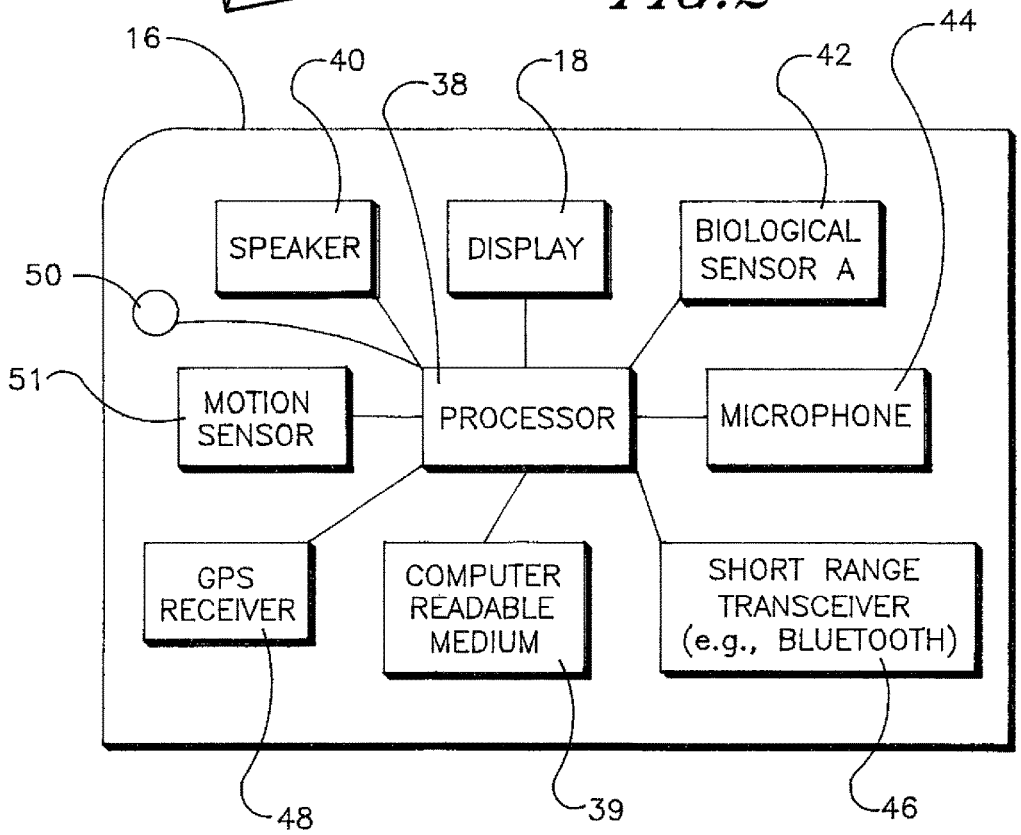

SERVER LOGIC

ACCOUTREMENT LOGIC

SMART WATCH WITH AUTOMATIC VOICE RECORDING AND ALARM

FIELD

The present application relates generally to wearable items such as wristwatches which can automatically start recording or the transmission of recording and alarm, as security measures.

BACKGROUND

Personal protection is a ubiquitous concern. In recent decades the participation of women in many solo activities formerly undertaken mostly by men has heightened this concern. Highly publicized criminal cases abound in which lone female joggers, for instance, are assaulted.

Present principles recognize that while the use of fingerprints and DNA analysis is value in determining criminal guilt, such evidence is not always available. As further understood herein, voice frequency of an attacker may be used as evidence to prosecute in a criminal case. Additionally, given that evidence preservation does nothing for a victim at the time of the crime, and given that a victim of a sudden assault cannot always be expected to take deliberated action to activate self-defense measures, present principles are provided.

SUMMARY OF THE INVENTION

Accordingly, a human-wearable accoutrement that may be configured as a watch includes a housing, a processor in the housing, and a shock sensor in the housing and sending signals representing physical shock to the processor. A speaker also is on the housing and is controlled by the processor. A computer readable storage medium is in the housing and is accessible to the processor. The medium bears instructions executable by the processor to generate an audible alarm responsive to a determination that a signal from the shock sensor indicates that a physical shock has occurred.

In some embodiments, the processor presents an onscreen display (OSD) on a display to enable a wearer of the accoutrement to select sound recording options (SRO). A first SRO can be for the accoutrement always to be recording ambient sounds which may be stored on the medium. The sounds can be continuously transmitted wirelessly by the accoutrement or in burst transmissions to a wireless telephone. In example implementations a second. SRO on the OSD can be to begin recording only upon entry into a panic mode.

If desired, the processor can present an onscreen display (OSD) on a display to enable a wearer of the accoutrement to select an alarm causing option (ACO) defining when to cause an alarm to be sounded on the speaker. A first ACO can be a physical shock and a second ACO can be one or more selected from a voice command, a loud bang, a sudden increase in a biological function of the wearer, and a manipulation of an alarm selector.

In another aspect, a human-wearable watch includes a housing, a processor in the housing, and a shock sensor in the housing and sending signals representing physical shock to the processor. A speaker also is on the housing and is controlled by the processor. A computer readable storage medium is in the housing and is accessible to the processor. The medium bears instructions executable by the processor to monitor a sensor on the watch sending signals to the processor. The processor, responsive to a determination that the signals indicate a trigger event, begins recording ambient audio and/or uploads audio to a wireless telephone.

In another aspect, a method executed by a computerized server includes receiving, from a wireless telephony device, a signal representing audio recorded by a human-wearable accoutrement. The method then includes determining whether a noise filter is to be applied to the audio to remove all audio except voice audio from the signal, and responsive to a determination that the noise filter is not to be applied, recording the signal received from the telephony device. On the other hand, responsive to a determination that the noise filter is to be applied, the method includes filtering out non-voice audio from the signal for the purpose of voice printing using voice frequencies to generate a voice-only output and recording the voice-only output.

The details of the present invention, both as to its structure and operation, can be best understood in reference to the accompanying drawings, in which like reference numerals refer to like parts, and in which:

BRIEF DESCRIPTION OF THE DRAWINGS

FIG. 1 is a perspective view of an example wearable accoutrement, in this case, a wristwatch, in accordance with present principles, communicating with a paired wireless telephone, showing the server and portions of the telephone schematically;

FIG. 2 is a block diagram of an example watch;

DETAILED DESCRIPTION OF THE PREFERRED EMBODIMENT

Figure 3:
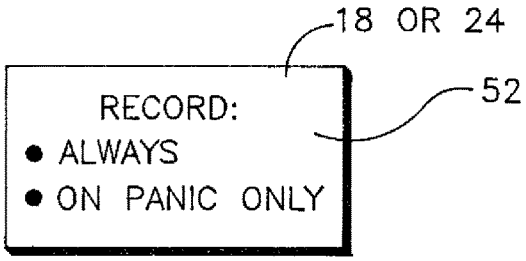
FIG. 3 is a screen shot of an example onscreen display (OSD) enabling a user to define when to record sounds.

Referring initially to FIG. 1, a system is shown, generally designated 10, which includes a wearable accoutrement 12 wirelessly communicating with a wireless telephone 14 using a short range communication link such as Bluetooth. In the example shown in FIG. 1, the accoutrement 12 is configured as a wristwatch having a watch body 16 bearing a time indication 18, either digital or analog (FIG. 1 shows a digital time display window for illustration purposes only). One or more manipulable buttons 20 may be arranged on the watch body as shown for purposes to be shortly disclosed. In other embodiments, the accoutrement 12 may be configured as something other than a wristwatch but with functionality apart from those divulged below, e.g., the accoutrement 12 may be configured as a bracelet, ring, belt, etc. When configured as a wristwatch, a flexible wristband 22 is engaged with the watch body 16 to hold the watch body 16 onto a person's wrist.

Before turning to the details of the wireless telephone 14, it is to be understood that in some embodiments, wireless telephony capability may be built in to the accoutrement 12. In the example shown, however, the wireless telephone 14 is separate from the accoutrement 12 and includes a visual display 24 supported on a portable hand held housing 26. A keypad 28 ordinarily is provided to enable a user to input a telephone number to a processor 30 accessing a computer readable storage medium 32 such as disk-based or solid state storage. The processor 30 communicates with the accoutrement 12 using a short range transceiver 34 such as a Bluetooth transceiver. The processor enables wide area telephony communication to one or more computerized servers 35 through a telephony transceiver 36 such as but not limited to a code division multiple access (CDMA) transceiver or variant thereof, a global system for communication (GSM) transceiver or variant thereof, or an orthogonal frequency division multiplex (OFDM) transceiver or variant thereof.

FIG. 2 shows details of the watch body 16 of the example accoutrement 12. A processor 38 in the body 16 accesses a computer readable storage medium 39 such as disk-based or solid state storage bearing instructions executable by the processor 38 to undertake logic described below. The processor 38 outputs audible sounds such as alarms on one or more speakers 40. Also, the processor 38 receives input from one or more biological sensors 42 such as a pulse sensor or body temperature sensor representing biological functions of the wearer of the accoutrement 12. The processor 38 may also receive data from a microphone 44 representing voice and other sounds. Communication with the wireless telephone 14 is effected using a short range transceiver 46 such as a Bluetooth transceiver. The processor 38 may receive geographic location information front a global position satellite (GPS) receiver 48 or other position receiver, and may receive signals representing images from an imager 50 such as but not limited to a charge coupled device (CCD). Motion of the accoutrement 12 including physical shocks may be sensed by a motion sensor 51 such as but not limited to a gyroscope communicating with the accoutrement processor 38.

With the example structures set forth above in mind, an onscreen display (OSD) 52 shown in FIG. 3 may be presented on the watch display 18 or wireless telephone display 24 to enable a person to select sound recording options. Note that the options shown in FIGS. 3 and 4 may alternatively be hard-coded into the accoutrement 12 by the manufacturer if it is desired to relieve the user of making choices or if it is desired to ensure that a particular option always is invoked by the accoutrement 12. A combination of user-selected and manufacturer-coded options may be used.

One option is for the accoutrement 12 always to be recording ambient sounds for storage on the accoutrement medium 39 and/or continuous or burst transmission of signals representing the sounds to the wireless telephone 14 via. Bluetooth, which can continuously or periodically upload the signals to a server on the wireless telephony network.

The server may be used to provide a subscription-based security service to the wearer of the accoutrement 12, such that, for a monthly fee for example, the wearer of the accoutrement 12 can access the server to have captured audio stored there for later retrieval by the wearer or by law enforcement agencies. Or, the server may itself be controlled by a law enforcement agency which may constantly monitor sing, e.g., computerized sound analysis that automatically generates a human-perceptible alarm) for suspicious sounds in signals received from the accoutrement 12 via the telephone 14, such as loud bangs indicating gunshots or voices of potential victims seeking help or voices of criminals assaulting the wearer. Further details of server side processing are divulged below.

The user may be enabled to select whether to store sounds locally or upload automatically if desired. Another option shown in the OSD of FIG. 3 is to begin recording only upon entry into a panic mode, examples of which are discussed below. The second option reduces the need for storage capacity onboard the accoutrement 12 while also avoiding the potential embarrassment of recording everything all the time should the wearer forget that recording is ongoing.

Figure 4:
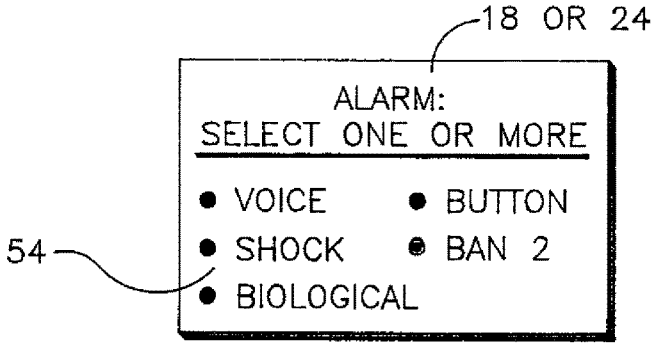
FIG. 4 is a screen shot of an example OSD enabling a user to define conditions under which the audible alarm is to be activated.

FIG. 4 shows an OSD 54 which may be presented on the watch display 18 or wireless telephone display 24 to enable a person to select when to cause an alarm to be sounded on the speaker 40. As shown, the wearer may select alarm activation to occur upon one or more events, which include a voice command (such as "alarm" sensed by the microphone 44 and recognized as such by the processor 38 using voice recognition principles, a loud bang sensed by the microphone 44 and recognized as such by the processor 38 by, e.g., noting a sudden large spike in the amplitude of the audio signal, a physical shock as sensed by the motion sensor 51 and recognized as such by the processor 38 by, e.g., noting a sudden large spike in the amplitude of the motion signal, a sudden increase in a biological function of the wearer as indicated by the biological sensor 42 which may indicate stress, such as an increase in pulse or body temperature that is recognized by the processor 38, and a manipulation of the button 20 shown in FIG. 1, which generates a signal to the processor 38 to activate the audible alarm. The above events may also double as panic mode events for purposes of starting recording if the user has selected the second option from the OSD 52 of FIG. 3. Or, a separate OSD may be presented similar to the OSD 54 of FIG. 4 but informing the user that selection is for events to begin recording and/or to upload recorded audio to the telephone 14, such that the user-selected event or events to begin recording/upload need not be the same as the user-selected event or events to activate the alarm.

Figure 5:
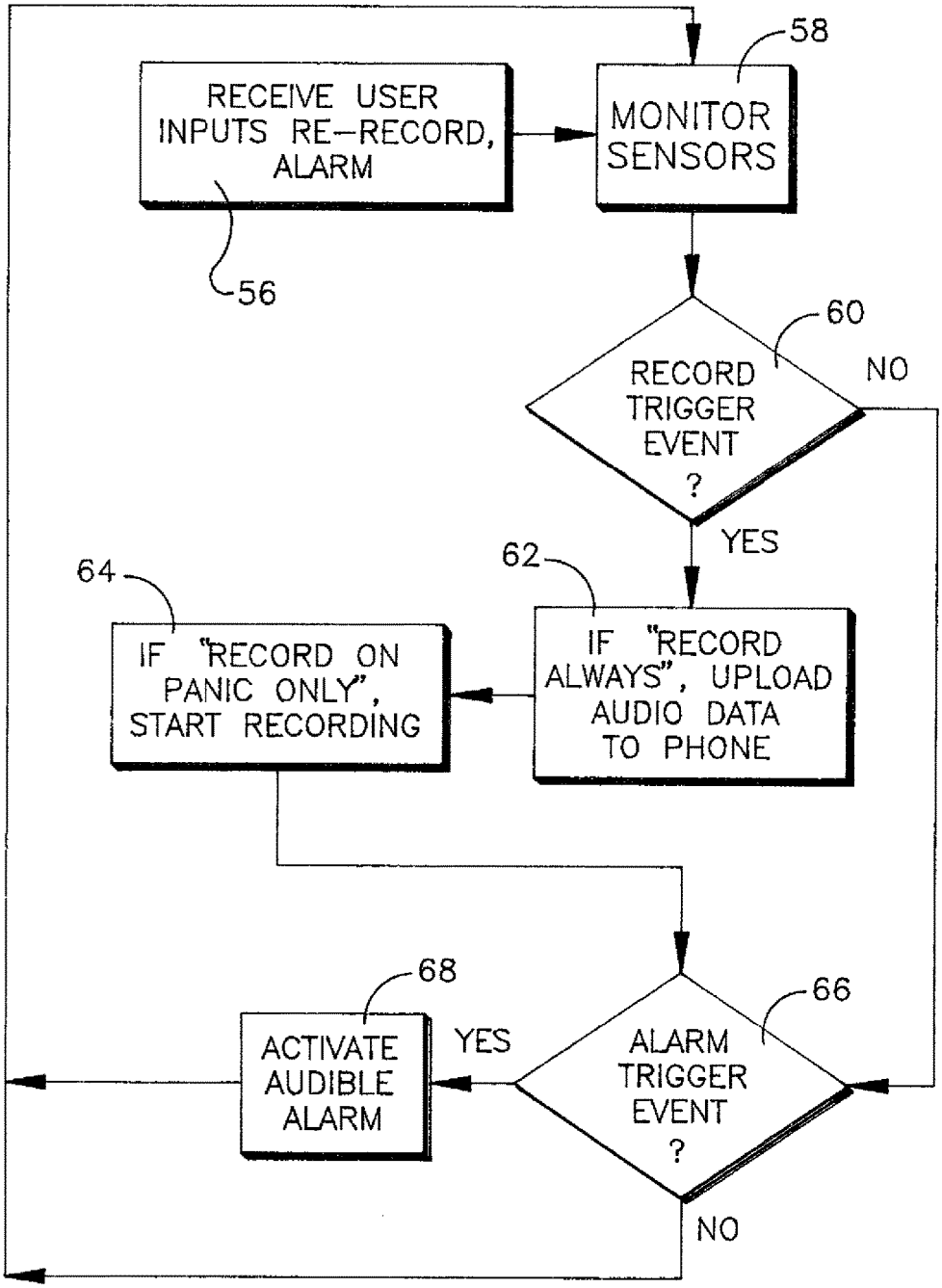
FIG. 5 is a flow chart of example accoutrement logic.

FIG. 5 shows example logic that may be executed by the processor 38 of the accoutrement 12 in accordance with present principles. Block 56 indicates that the processor receives user inputs from the OSDs shown in FIGS. 3 and 4 as described above, and then at block 58 monitors the various sensors on the accoutrement 12. When a trigger event to begin audio recording is received at decision diamond 60, at block 62 any recorded audio is uploaded if not already uploaded to the telephone 14. Preferably, the upload is on a last in-first out basis, meaning that the most recently recorded audio is uploaded before older recorded audio. If the user has selected to record only upon entry into a panic mode, then at block 64 recording is commenced, if desired simultaneously uploading the audio to the telephone 14 for immediate transmission to the above-described server. Note that video from the imaging device 50 may also be recorded according to the logic of FIG. 5.

From block 64 or from decision diamond 60 if the test there was negative, the logic determines at decision diamond 66 whether an alarm-triggering event has occurred according to the user selections in FIG. 4. If it has, the audible alarm is activated over the speaker 40 at block 68. Preferably, the audible alarm is loud and may be an obvious warning such as a siren or wailing sound, or a voice alarm such as "help", intended to induce an attacker to flee. Monitoring continues at block 58 as shown.

Figure 6:
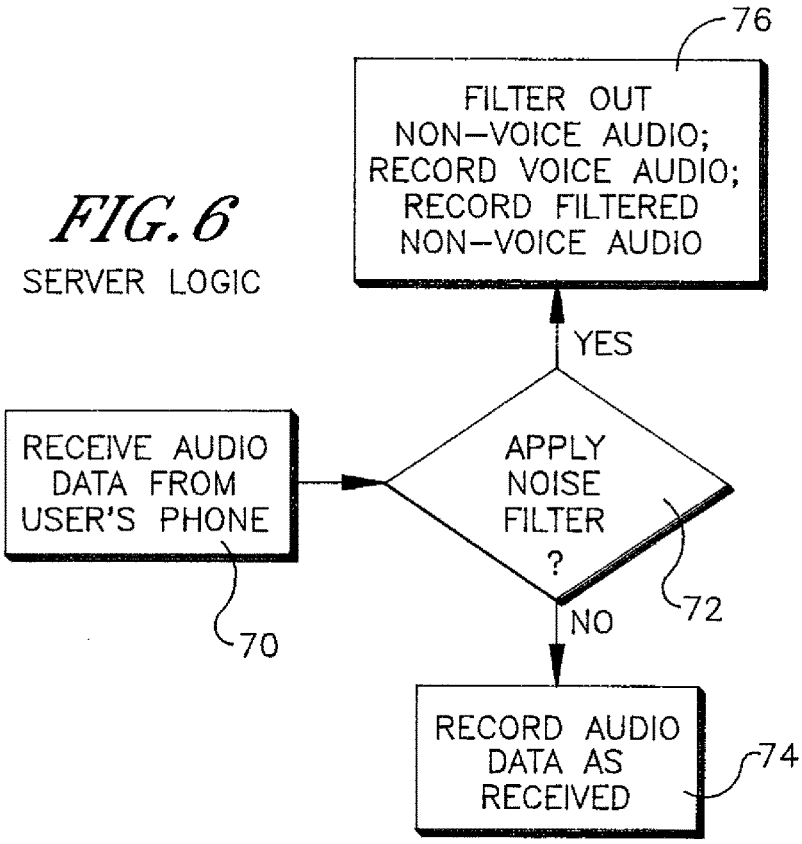
FIG. 6 is a flow chart of example server logic.

Now referring to the server-side back end logic of FIG. 6, audio is received by the server 35 from the accoutrement 12 via the telephone 14 at block 70. At decision diamond 72, if the operator of the server 35 has not elected to apply a white noise filter to remove all audio except voice audio front the signal, the audio as received from the telephone 74 is recorded at the server at block 74. However, recognizing that it sometimes may be desirable to filter out all non-voice audio from a signal for the purpose of voice printing using voice frequencies, which has potential evidentiary uses in criminal trials, if filtering is selected then the logic moves to block 76 to filter out all non-voice sound from the audio signal. The voice-only output is then recorded. Desirably, however, the filtered-out noise (or the original signal prior to filtering) may also be recorded by the server to preserve evidence of potentially important non-voice audio data, such as gunshots.

While the particular SMART WATCH WITH AUTOMATIC VOICE RECORDING AND ALARM is herein shown and described in detail, it is to be understood that the subject matter which is encompassed by the present invention is limited only by the claims.

What is claimed is:

1. Method executed by a computerized server comprising:

receiving, from a wireless telephony device, a signal representing audio recorded by a human-wearable accoutrement;

determining whether a noise filter is to be applied to the audio to remove all audio except voice audio from the signal;

responsive to a determination that the noise filter is not to be applied, recording the signal received from the telephony device; and responsive to a determination that the noise filter is to be applied, filtering out non-voice audio from the signal for the purpose of voice printing using voice frequencies to generate a voice-only output and recording the voice-only output.

2. The method of claim 1, comprising recording noise filtered out of the signal, or recording the signal received from the telephony device prior to filtering the signal, or recording noise filtered out of the signal and recording the signal received from the telephony device prior to filtering the signal.

3. The method of claim 1, comprising providing a security service to a wearer of the accoutrement, such that a person can access the server to retrieve audio stored therein.

4. The method of claim 3, wherein the service is subscription-based and the person is the wearer of the accoutrement who can access the audio stored at the server in exchange for remuneration.

5. A computerized server comprising:

at least one processor; and at least one computer storage accessible to the at least one processor and comprising instructions executable by the at least one processor to:

receive, from a wireless telephony device, a signal representing audio recorded by a human-wearable accoutrement;

determine whether a noise filter is to be applied to the audio to remove all audio except voice audio from the signal;

responsive to a determination that the noise filter is not to be applied, record the signal received from the telephony device; and responsive to a determination that the noise filter is to be applied, filter out non-voice audio from the signal for the purpose of voice printing using voice frequencies to generate a voice-only output and recording the voice-only output.

6. The computerized server of claim 5, wherein the instructions are executable for recording noise filtered out of the signal, or recording the signal received from the telephony device prior to filtering the signal, or recording noise filtered out of the signal and recording the signal received from the telephony device prior to filtering the signal.

7. The computerized server of claim 5, wherein the instructions are executable for providing a security service to a wearer of the accoutrement, such that a person can access the server to retrieve audio stored therein.

8. The computerized server of claim 7, wherein the service is subscription-based and the person is the wearer of the accoutrement who can access the audio stored at the server in exchange for remuneration.

* * * * *